US008514152B2

(12) United States Patent
Park

(10) Patent No.: US 8,514,152 B2
(45) Date of Patent: Aug. 20, 2013

(54) DISPLAY DEVICE WITH IMPROVED LUMINANCE UNIFORMITY AMONG PIXELS AND DRIVING METHOD THEREOF

(75) Inventor: Seong-Il Park, Seoul (KR)

(73) Assignee: Samsung Display Co., Ltd., Yongin (KR)

( * ) Notice: Subject to any disclaimer, the term of this patent is extended or adjusted under 35 U.S.C. 154(b) by 596 days.

(21) Appl. No.: 12/534,389

(22) Filed: Aug. 3, 2009

(65) Prior Publication Data

US 2010/0194716 A1 Aug. 5, 2010

(30) Foreign Application Priority Data

Feb. 5, 2009 (KR) ..... 10-2009-0009446

(51) Int. Cl.
*G09G 3/30* (2006.01)

(52) U.S. Cl.
USPC ..... 345/76; 345/82

(58) Field of Classification Search
USPC ..... 345/76, 204, 77, 82, 91, 690
See application file for complete search history.

(56) References Cited

U.S. PATENT DOCUMENTS

| | | | | |
|---|---|---|---|---|
| 2004/0070557 | A1* | 4/2004 | Asano et al. | 345/76 |
| 2004/0155842 | A1* | 8/2004 | Ishizuka | 345/76 |
| 2005/0212787 | A1* | 9/2005 | Noguchi et al. | 345/204 |
| 2006/0170628 | A1 | 8/2006 | Yamashita | |
| 2006/0221662 | A1* | 10/2006 | Park et al. | 365/145 |
| 2007/0040772 | A1* | 2/2007 | Kim | 345/76 |
| 2007/0103406 | A1* | 5/2007 | Kim | 345/76 |
| 2008/0024529 | A1* | 1/2008 | Asano et al. | 345/697 |
| 2008/0030446 | A1 | 2/2008 | Asano | |
| 2008/0048955 | A1 | 2/2008 | Yumoto | |

FOREIGN PATENT DOCUMENTS

| | | |
|---|---|---|
| JP | 2005-141163 | 6/2005 |
| JP | 2008-039875 | 2/2008 |
| JP | 2008-051960 | 3/2008 |
| JP | 2008-058940 | 3/2008 |
| JP | 2008-233652 | 10/2008 |
| KR | 2005-105534 | 11/2005 |
| KR | 10-2006-0073695 | 6/2006 |
| KR | 10-0613093 | 6/2006 |
| KR | 10-2006-0118826 | 11/2006 |
| KR | 2008-012167 | 2/2008 |
| KR | 2008-018106 | 2/2008 |
| KR | 10-0824854 | 4/2008 |

* cited by examiner

*Primary Examiner* — Chanh Nguyen
*Assistant Examiner* — Pegeman Karimi
(74) *Attorney, Agent, or Firm* — H.C. Park & Associates, PLC

(57) ABSTRACT

A display device and a driving method thereof. The display device includes a plurality of pixels arranged in a matrix. Each pixel includes a light-emitting element, a driving transistor including an input terminal connected to a first node, a control terminal connected to a second node, and an output terminal, a capacitor connected between the second node and a driving voltage terminal, a switching transistor to transmit a data voltage to the first node, an emission control transistor connected between the output terminal of the driving transistor and the light-emitting element, a first compensation transistor connected between the second node and the output terminal of the driving transistor, a second compensation transistor to transmit a mobility compensation voltage to the first node, a driving control transistor to transmit a driving voltage to the first node, and a reset transistor to transmit a reset voltage to the emission control transistor.

25 Claims, 13 Drawing Sheets

DISPLAY DEVICE WITH IMPROVED LUMINANCE UNIFORMITY AMONG PIXELS AND DRIVING METHOD THEREOF

CROSS REFERENCE TO RELATED APPLICATION

This application claims priority to and the benefit of Korean Patent Application No. 10-2009-0009446, filed on Feb. 5, 2009, which is hereby incorporated by reference for all purposes as if fully set forth herein.

BACKGROUND OF THE INVENTION

1. Field of the Invention

The present invention relates to a display device and a driving method thereof, and particularly to an organic light emitting device and a driving method thereof.

2. Discussion of the Background

A hole-type flat panel display such as an organic light emitting device displays a fixed picture for a predetermined time period, for example for a frame, regardless of whether the picture is a still picture or a motion picture. As an example, when some continuously moving object is displayed, the object stays at a specific position for a frame and then stays at a next position to which the object was moved after a time period of a frame in a next frame, i.e., movement of the object is discretely displayed. Since an afterimage is maintained within one frame, the motion of the object is displayed as continuous when it is displayed through the above-noted method.

However, when a user views the moving object on the screen, since the user's eyes continue to move as the object moves, the screen display is blurred by the mismatched display with the discrete displaying method by the display device. For example, assuming that the display device displays that an object stays at the position A in the first frame and it stays at the position B in the second frame, the user's eyes move along the object's expected moving path from the position A to the position B in the first frame. However, the object is not actually displayed at intermediate positions other than the positions A and B.

Resultantly, the object appears blurred since the luminance sensed by the user during the first frame is acquired by integrating the luminance of pixels on the path between the positions A and B, that is, the average of the luminance of the object and the luminance of the background.

The pixel of the organic light emitting device includes an organic light emitting element and a thin film transistor (TFT) for driving the organic light emitting element, and when they are operated for a long time, the threshold voltage is varied so that the expected luminance may not be output, and when the characteristic of a semiconductor included in the thin film transistor is not uniform in the display device, luminance deviation between the pixels may occur.

SUMMARY OF THE INVENTION

Exemplary embodiments of the present invention provide a display device to emit light of varying intensity from an organic light emitting element according to the magnitude of a current that is compensated for a characteristic deviation such that an image having uniform luminance may be displayed.

Exemplary embodiments of the present invention also provide a method of compensating for a characteristic deviation such that an image having uniform luminance may be displayed in a display device.

Additional features of the invention will be set forth in the description which follows, and in part will be apparent from the description, or may be learned by practice of the invention.

An exemplary embodiment of the present invention discloses a display device that includes a plurality of pixels arranged in a matrix form. Each pixel includes a light-emitting element and a driving transistor including an input terminal connected to a first node, a control terminal connected to a second node, and an output terminal. A capacitor is connected between the second node and a driving voltage terminal. A switching transistor, which is controlled by a first scanning signal to transmit a data voltage to the first node, is also included in each pixel. An emission control transistor, which is controlled by a second scanning signal, is connected between the output terminal of the driving transistor and the light-emitting element. A first compensation transistor, which is controlled by a third scanning signal, is connected between the second node and the output terminal of the driving transistor. A second compensation transistor, which is controlled by a fourth scanning signal to transmit a mobility compensation voltage to the first node, a driving control transistor, which is controlled by a fifth scanning signal to transmit a driving voltage to the first node, and a reset transistor, which is controlled by a sixth scanning signal to transmit a reset voltage to the emission control transistor, are also included in each pixel.

An exemplary embodiment of the present invention also discloses a method for driving a display device including a light-emitting element, a driving transistor including an input terminal connected to a first node and a control terminal connected to a second node, a capacitor connected between the second node and a driving voltage terminal, a switching transistor transmitting a data voltage to the first node, an emission control transistor connected between the driving transistor and the light-emitting element, a first compensation transistor connected between the second node and an output terminal of the driving transistor, a second compensation transistor transmitting a mobility compensation voltage to the first node, a driving control transistor transmitting the driving voltage to the first node, and a reset transistor transmitting a reset voltage to the emission control transistor. The method includes applying the reset voltage to the second node; compensating a threshold voltage of the driving transistor; compensating a mobility of the driving transistor; and emitting light at the light-emitting element. It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
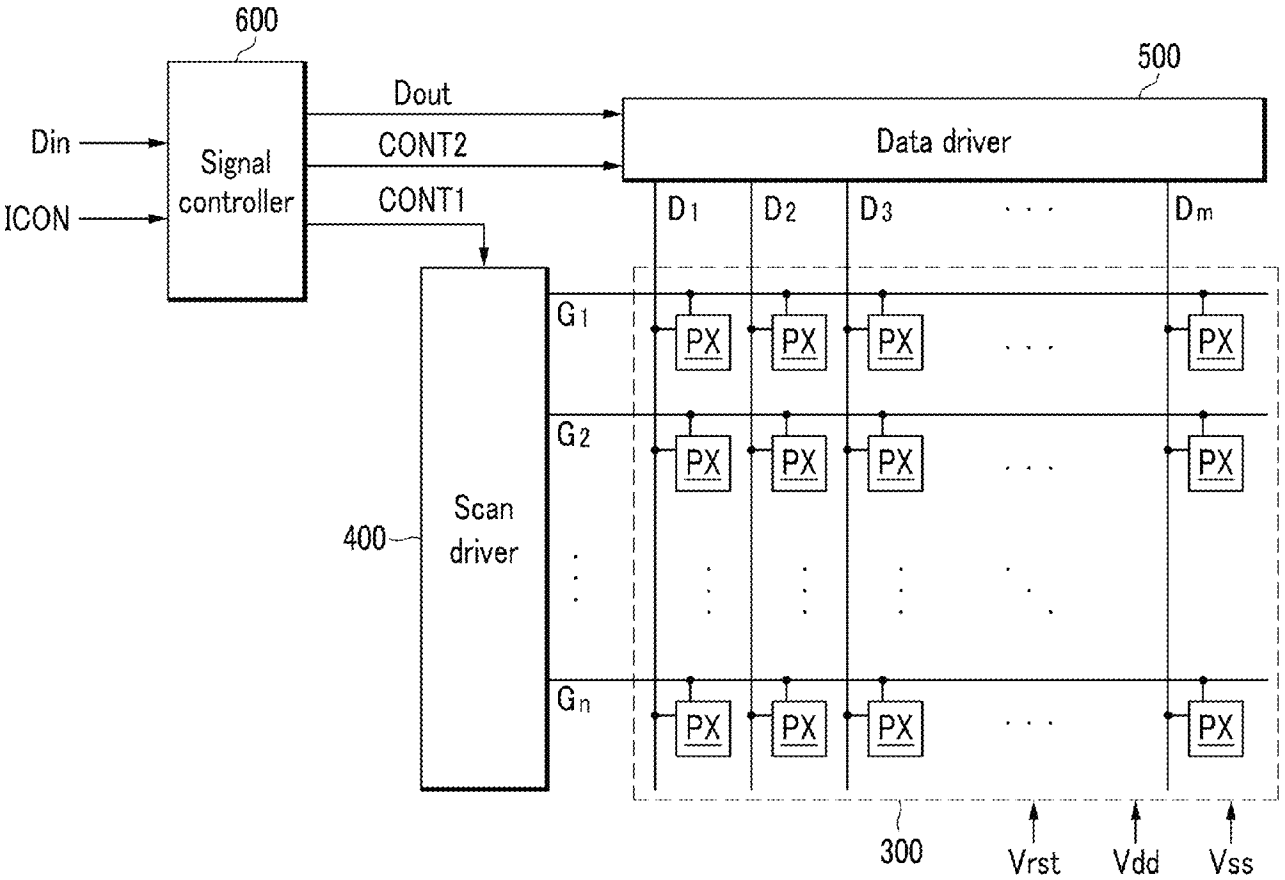
FIG. 1 is a block diagram of an organic light emitting device according to an exemplary embodiment of the present invention.

The invention is described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

An organic light emitting device according to an exemplary embodiment of the present invention will now be described with reference to FIG. 1 and FIG. 2.

Figure 2:
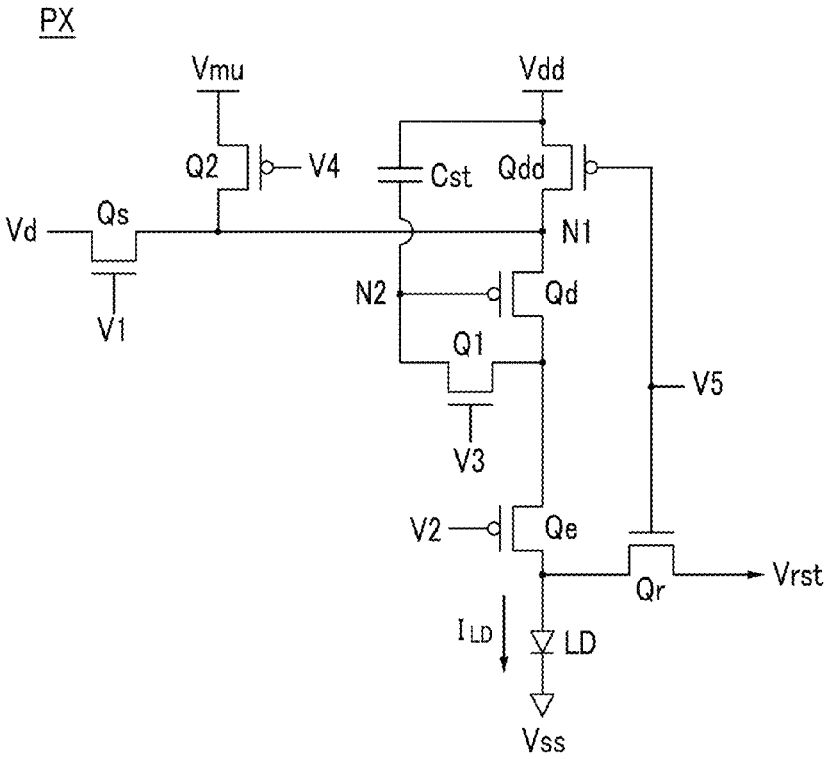
FIG. 2 is an equivalent circuit diagram of a pixel in an organic light emitting device according to an exemplary embodiment of the present invention.

FIG. 1 is a block diagram of an organic light emitting device according to an exemplary embodiment of the present invention, and FIG. 2 is an equivalent circuit diagram of a pixel in an organic light emitting device according to an exemplary embodiment of the present invention.

Referring to FIG. 1, the organic light emitting device includes a display panel 300, a scan driver 400, a data driver 500, and a signal controller 600.

The display panel 300 includes a plurality of signal lines (not shown), a plurality of voltage lines (not shown), and a plurality of pixels PX connected thereto and substantially arranged in a matrix form.

Referring to FIG. 1 and FIG. 2, the signal lines include a plurality of scanning signal lines $G_1$-$G_n$ for transmitting a first scanning signal V1, a plurality of scanning signal lines (not shown) for transmitting a second scanning signal V2, a third scanning signal V3, a fourth scanning signal V4, and a fifth scanning signal V5, and a plurality of data lines $D_1$-$D_m$ for transmitting a data signal as a data voltage Vd. The scanning signal lines $G_1$-$G_n$ are extended in the row direction and are substantially in parallel with each other, and the data lines $D_1$-$D_m$ are extended in the column direction and are substantially in parallel with each other.

The voltage lines include a driving voltage line (not shown) for transmitting a driving voltage Vdd, a common voltage line (not shown) for transmitting a common voltage Vss, and a reset voltage line (not shown) for transmitting a reset voltage Vrst.

As shown in FIG. 2, the pixel PX includes an organic light emitting element LD, a driving transistor Qd, a capacitor Cst, a switching transistor Qs, a first compensation transistor Q1, a second compensation transistor Q2, a driving control transistor Qdd, an emission control transistor Qe, and a reset transistor Qr.

Each of the transistors Q1, Q2, Qd, Qdd, Qe, Qr, and Qs has an output terminal, an input terminal, and a control terminal.

The control terminal of the switching transistor Qs is connected to receive the first scanning signal V1, the input terminal thereof is connected to receive the data voltage Vd, and the output terminal thereof is connected to the driving transistor Qd at a first node N1. The switching transistor Qs transmits the data voltage Vd to the input terminal of the driving transistor Qd in response to the first scanning signal V1.

The control terminal of the driving transistor Qd is connected to the capacitor Cst and the output terminal of the first compensation transistor Q1 at a second node N2, the input terminal thereof is connected to the driving control transistor Qdd at the first node N1, and the output terminal thereof is connected to the input terminal of the first compensation transistor Q1 and the emission control transistor Qe.

A first terminal of the capacitor Cst is connected to the control terminal of the driving transistor Qd and the first compensation transistor Q1 at the second node N2, and a second terminal of the capacitor Cst is connected to the driving voltage Vdd. The capacitor Cst charges the voltage of the second node N2, and maintains the charged voltage while the organic light emitting element LD flows a current.

The control terminal of the driving control transistor Qdd is connected to receive the fifth scanning signal V5, the input terminal thereof is connected to the terminal of the driving voltage Vdd, and the output terminal thereof is connected to the driving transistor Qd. The driving control transistor Qdd transmits the driving voltage Vdd to the driving transistor Qd in response to the fifth scanning signal V5.

The control terminal of the emission control transistor Qe is connected to receive the second scanning signal V2, the input terminal thereof is connected to the driving transistor Qd, and the output terminal thereof is connected to the organic light emitting element LD and the reset transistor Qr. The emission control transistor Qe transmits the reset voltage Vrst to the first compensation transistor Q1 or transmits the current $I_{LD}$ of the driving transistor Qd to the organic light emitting element LD in response to the second scanning signal V2.

The organic light emitting element LD as an organic light emitting diode (OLED) has an anode connected to the emission control transistor Qe and a cathode connected to the common voltage Vss. The organic light emitting element LD displays images by emitting light by varying the intensity thereof according to the current $I_{LD}$ supplied by the driving transistor Qd, and the current $I_{LD}$ depends on the voltage between the control terminal and the input terminal of the driving transistor Qd, that is, the voltage difference between the first node N1 and the second node N2.

The control terminal of the reset transistor Qr is connected to receive the fifth scanning signal V5, the input terminal thereof is connected to the terminal of the reset voltage Vrst, and the output terminal thereof is connected to the emission control transistor Qe. The reset transistor Qr transmits the reset voltage Vrst to the emission control transistor Qe in response to the fifth scanning signal V5. The reset voltage Vrst has a magnitude at which the organic light emitting element LD does not emit light with respect to the common voltage Vss. That is, the reset voltage Vrst may be less than an emission threshold voltage at which the organic light emitting element LD starts to emit light with respect to the common voltage Vss.

The control terminal of the first compensation transistor Q1 is connected to receive the third scanning signal V3, the input terminal thereof is connected to the output terminal of the driving transistor Qd, and the output terminal thereof is connected to the control terminal of the driving transistor Qd at the second node N2.

The control terminal of the second compensation transistor Q2 is connected to receive the fourth scanning signal V4, the input terminal thereof is connected to a mobility compensation voltage Vmu, and the output terminal thereof is connected to the first node N1. The second compensation transistor Q2 transmits the mobility compensation voltage Vmu to the input terminal of the driving transistor Qd through the first node N1 in response to the fourth scanning signal V4. The mobility compensation voltage Vmu may be larger than the data voltage Vd and less than the driving voltage Vdd.

The switching transistor Qs, the reset transistor Qr, and the first compensation transistor Q1 are n-channel electric field effect transistors (FETs), and the driving transistor Qd, the driving control transistor (Qdd), the second compensation transistor Q2, and the emission control transistor Qe are p-channel electric field effect transistors. An example of the electric field effect transistor may be a thin film transistor (TFT), and it may include polysilicon or amorphous silicon. The channel type of the transistors Qs, Qd, Qdd, Qe, Qr, Q1, and Q2 may be exchanged, and the waveform of the signals for driving them may be exchanged accordingly.

Referring to FIG. 1 again, the scan driver 400 is connected to the scanning signal lines $G_1$-$G_n$ of the display panel 300, and it applies the first scanning signal V1 which is a combination of a high voltage Von and a low voltage Voff to the scanning signal lines $G_1$-$G_n$. A plurality of scanning signal lines (not shown) transmitting the second scanning signal V2, the third scanning signal V3, the fourth scanning signal V4 and the fifth scanning signal V5 are connected to the scan driver (not shown), respectively, such that they may respectively receive the second scanning signal V2, the third scanning signal V3, the fourth scanning signal V4 and the fifth scanning signal V5 that are made of a combination of a high voltage Von and a low voltage Voff.

The data driver 500 connected to the data lines $D_1$-$D_m$ of the display panel 300 applies the data voltage Vd for displaying an image, to the data lines $D_1$-$D_m$.

The signal controller 600 controls the scan driver 400 and the data driver 500.

The respective drivers 400, 500, and 600 can be directly installed on the display panel 300 as at least one IC chip, they can be installed on a flexible printed circuit film (not shown) and then attached on the display panel 300 in a tape carrier package (TCP) form, or they can be installed on an additional printed circuit board (PCB) (not shown). Differing from this, the drivers 400, 500, and 600 can be integrated on the display panel 300 with the signal lines $G_1$-$G_n$ and $D_1$-$D_m$ and the transistors Qs, Qd, Qdd, Qe, Qr, Q1, and Q2. Further, the drivers 400, 500, and 600 can be integrated as a single chip, and in this case, at least one of them or at least one circuit element configuring them can be provided outside the single chip.

A display operation according to an exemplary embodiment of the present invention of the organic light emitting device will now be described with reference to FIG. 3, FIG. 4, FIG. 5, FIG. 6, FIG. 7 and FIG. 8 as well as FIG. 1 and FIG. 2.

Figure 3:
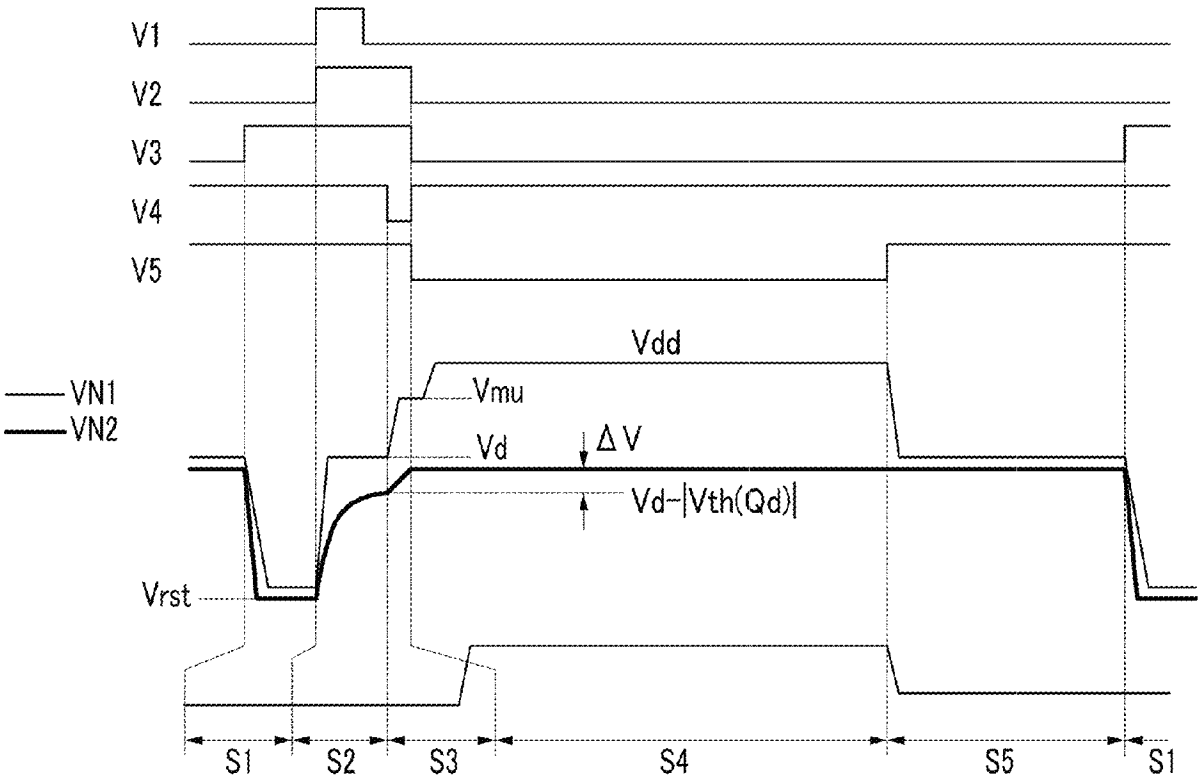
FIG. 3 is a waveform diagram of a driving signal applied to a pixel row and voltages at nodes in an organic light emitting device according to an exemplary embodiment of the present invention.
Figure 9:
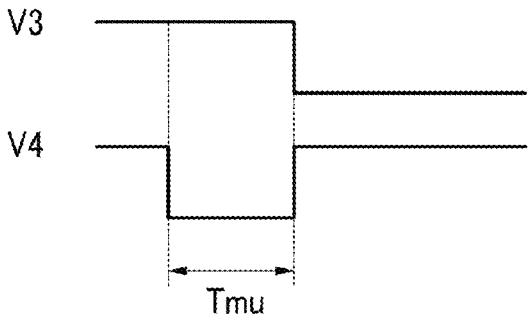
FIG. 9 is a waveform diagram showing a relationship of two driving signals in an organic light emitting device according to an exemplary embodiment of the present invention.
Figure 10:
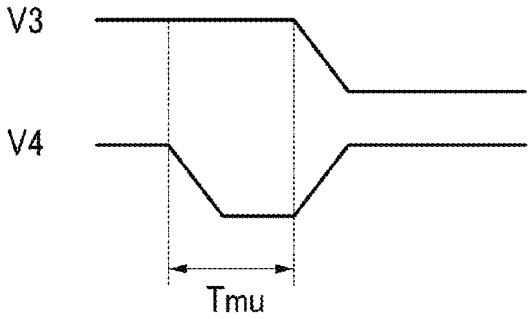
FIG. 10 is a waveform diagram showing a relationship of two driving signals in an organic light emitting device according to an exemplary embodiment of the present invention.

FIG. 3 is a waveform diagram of a driving signal applied to a pixel row and voltages at nodes in an organic light emitting device according to an exemplary embodiment of the present invention. FIG. 4, FIG. 5, FIG. 6, FIG. 7 and FIG. 8 are equivalent circuit diagrams of a pixel in the respective periods S1, S2, S3, S4, and S5 of FIG. 3. FIG. 9 and FIG. 10 are waveform diagrams showing a relationship of two driving signals in an organic light emitting device according to an exemplary embodiment of the present invention.

The signal controller 600 receives an input image signal Din and an input control signal ICON for controlling display thereof from an external graphics controller (not shown). The input image signal Din has luminance information of each pixel PX, and the luminance has a predetermined number of grays, for example $1024=2^{10}$, $256=2^8$, or $64=2^6$. Examples of the input control signal ICON are a vertical synchronization signal, a horizontal synchronizing signal, a main clock signal, and a data enable signal.

The signal controller 600 processes the input image signal Din according to an operating condition of the display panel 300 based on the input image signal Din and the input control signal ICON, and generates a scan control signal CONT1 and a data control signal CONT2. The signal controller 600 transmits the scan control signal CONT1 to the scan driver 400, and transmits the data control signal CONT2 and the output image signal Dout to the data driver 500.

The scan control signal CONT1 may include a scanning start signal (STV) for instructing a scan start of a high voltage Von for the scanning signal line and the compensation signal line, at least one clock signal for controlling an output period of the high voltage Von, and an output enable signal (OE) for controlling duration of the high voltage Von.

The data control signal CONT2 includes a horizontal synchronization start signal for notifying the data driver 500 of a transmission start of a digital image signal Dout for the pixels PX of a row, a load signal for applying an analog data voltage Vd to the data line $D_1$-$D_m$, and a data clock signal.

The scan driver 400 sequentially changes the first scanning signal V1, the second scanning signal V2, the third scanning signal V3, the fourth scanning signal V4, and the fifth scanning signal V5 applied to the various signal lines including the scanning signal lines $G_1$-$G_n$ according to the scan control signal CONT1 provided by the signal controller 600 into a high voltage Von and then into a low voltage Voff. The scan driver 400 may include a plurality of drivers (not shown) for respectively driving the first scanning signal V1, the second scanning signal V2, the third scanning signal V3, the fourth scanning signal V4, and the fifth scanning signal V5.

According to the data control signal CONT2 provided by the signal controller 600, the data driver 500 receives the digital output image signal Dout for the pixels PX of each row, converts the output image signal Dout into an analog data voltage Vd, and applies it to the data line.

A specific pixel row (e.g., the i-th row) during one frame in which the first scanning signal V1 is applied to all scanning signal lines $G_1$-$G_n$ will now be described.

First, referring to FIG. 3, a reset period S1 starts by changing the third scanning signal V3 into the high voltage Von in the state that the first scanning signal V1 and the second scanning signal V2 are the low voltage Voff and the fourth scanning signal V4 and the fifth scanning signal V5 are the high voltage Von.

Figure 4:
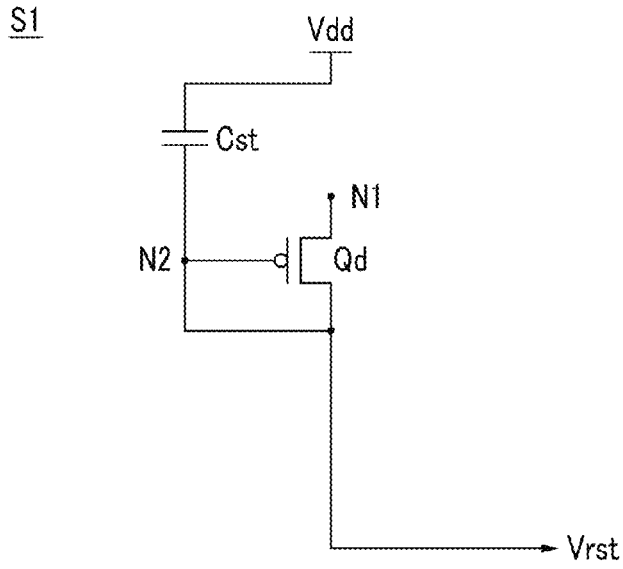
FIG. 4 is an equivalent circuit diagram of a pixel in the period S1 of FIG. 3.

Accordingly, as shown in FIG. 4, in the state that the switching transistor Qs, the mobility compensation transistor Q2, and the driving control transistor Qdd are turned off, the first compensation transistor Q1, the emission control transistor Qe, and the reset transistor Qr are turned on, such that the second node N2 is applied with the reset voltage Vrst. Thus, the driving transistor Qd is also turned on to thereby flow the current, and the voltage of the input terminal of the driving transistor Qd, that is, the voltage VN1 of the first node N1, is decreased to near the reset voltage Vrst. The difference between the voltage VN1 of the first node N1 and the voltage VN2 of the second node N2 may be equal to an absolute value of the threshold voltage Vth of the driving transistor Qd.

Next, referring to FIG. 3, in the state that the third scanning signal V3, the fourth scanning signal V4, and the fifth scanning signal V5 maintain the high voltage Von, the first scanning signal V1 and the second scanning signals V2 are changed into the high voltage Von, such that the threshold voltage compensation period S2 starts.

Figure 5:
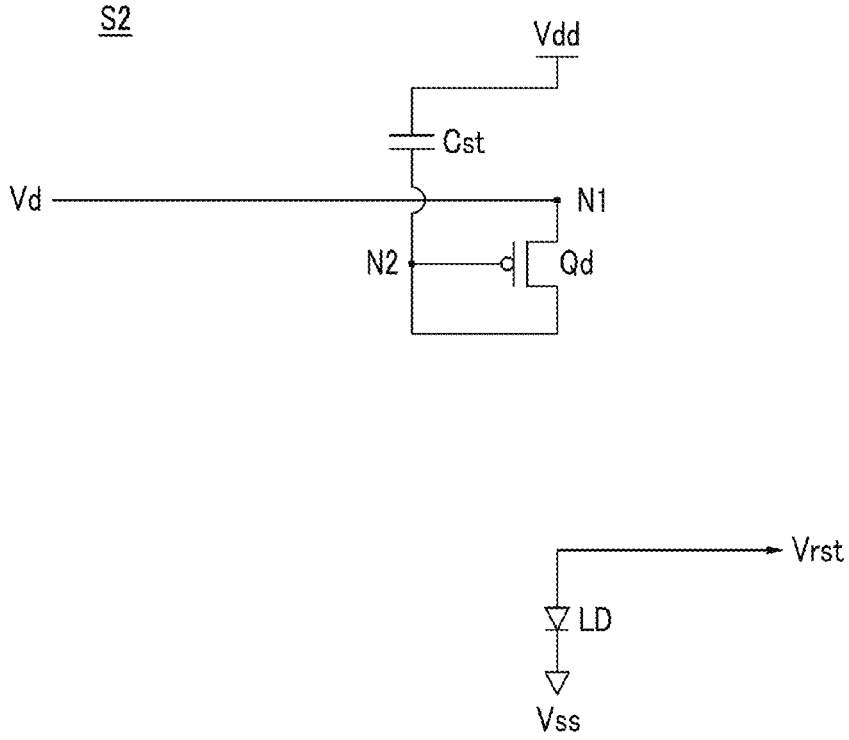
FIG. 5 is an equivalent circuit diagram of a pixel in the period S2 of FIG. 3.

Thus, as shown in FIG. 5, in the state that the first compensation transistor Q1 is turned on, the emission control transistor Qe is turned off, and the switching transistor Qs is turned on, such that the first node N1 is applied with the data voltage Vd. Also, a current flows from the input terminal to the output terminal of the turned on driving transistor Qd, and the voltage VN2 of the second node N2 is increased until the voltage difference between the first node N1 and the second node N2 is equal to the absolute value of the threshold voltage Vth of the driving transistor Qd. Accordingly, when the threshold voltage compensation period S2 is finished, the voltage VN1 of the first node N1 and the voltage VN2 of the second node N2 have the values represented by Equation 1, as shown in FIG. 3.

$$VN1 = Vd \quad \text{(Equation 1)}$$

$$VN2 = Vd - |Vth\ Qd|$$

Accordingly, the absolute value of the threshold voltage Vth of the driving transistor Qd is additionally stored in the capacitor Cst, such that the deviation of the threshold voltages Vth of the respective driving transistors Qd may be compensated, and thereby non-uniform luminance of the organic light emitting device may be prevented.

Next, referring to FIG. 3, in the state that the second scanning signal V2, the third scanning signal V3, and the fifth scanning signal V5 are the high voltage Von, and the first scanning signal V1 is the low voltage Voff, the fourth scanning signal V4 is changed into the low voltage Voff, such that the compensation period S3 of the electric field effect mobility μ (hereinafter, "mobility") starts.

Figure 6:
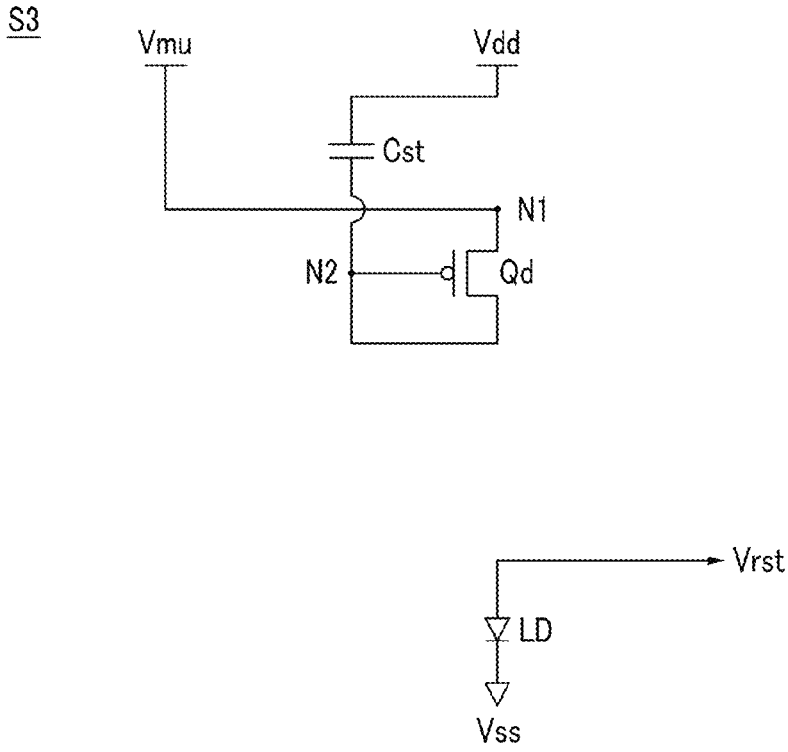
FIG. 6 is an equivalent circuit diagram of a pixel in the period S3 of FIG. 3.

As shown in FIG. 6, the second compensation transistor Q2 is turned on, such that the first node N1 is applied with the mobility compensation voltage Vmu instead of the data voltage Vd. The mobility compensation voltage Vmu may be less than the driving voltage Vdd and larger than the data voltage Vd. Accordingly, a current flows from the input terminal to the output terminal of the driving transistor Qd such that the voltage VN2 of the second node N2 is increased. The increasing speed and the increasing degree of the voltage VN2 of the second node N2 become large as the mobility μ of the driving transistor Qd increases. The voltages VN1 of the first node N1 and VN2 of the second node N2 when the mobility compensation period S3 is finished may be represented by Equation 2.

$$VN1 = Vmu \quad \text{(Equation 2)}$$

$$VN2 = Vd - |Vth\ Qd| + \Delta V$$

Here, ΔV is the change amount ΔV of the voltage VN2 of the second node N2. The change amount ΔV of the voltage VN2 of the second node N2 becomes large as the mobility μ of the driving transistor Qd increases, and the voltage that is decreased by the change amount ΔV of the voltage VN2 of the second node N2 is stored in the capacitor Cst. Accordingly, the voltage stored in the capacitor Cst becomes small as the mobility μ of the driving transistor Qd increases, such that the deviation of the mobility μ of the driving transistor Qd may be compensated through the mobility compensation period S3, and thereby non-uniformity of the luminance of the organic light emitting device may be prevented.

As shown in FIG. 3 and FIG. 9, the deviation compensation of the mobility μ of the driving transistor Qd is generated during the overlapping period of the interval that the third scanning signal V3 is the high voltage Von and the interval that the fourth scanning signal V4 is the low voltage Voff, that is, during a mobility compensation time Tmu. Accordingly, the compensation degree of the deviation of the mobility μ of the driving transistor Qd may be controlled by appropriately selecting the mobility compensation time Tmu. If the mobility compensation time Tmu is large, the voltage change amount ΔV of the second node N2 is large, but the luminance is decreased. Therefore, the mobility compensation time Tmu may be appropriately selected according to the deviation degree of the mobility μ of the driving transistor Qd.

Also, referring to FIG. 9 and FIG. 10, it may be found that the mobility compensation time Tmu when no signal delay is generated in the third scanning signal V3 and the fourth scanning signal V4 as shown in FIG. 9 is substantially the same as the mobility compensation time Tmu when a signal delay is generated in the third scanning signal V3 and the fourth scanning signal V4 as shown in FIG. 10. In this way, the deviation compensation of the mobility μ of the driving transistor Qd occurs in the overlapping period of the interval when the third scanning signal V3 is the high voltage Von and the fourth scanning signal V4 is the low voltage Voff, such that a uniform mobility compensation time Tmu may be obtained regardless of signal delay of the third scanning signal V3 and the fourth scanning signal V4 according to position in the display panel 300.

On the other hand, the compensation degree of the mobility μ of the driving transistor Qd, that is, the voltage change amount ΔV of the second node N2, may be appropriately controlled by appropriately selecting the value of the mobility compensation voltage Vmu along with the mobility compensation time Tmu. Alternatively, the mobility compensation voltage Vmu may be the same as the driving voltage Vdd, and in this case, the second compensation transistor Q2 may be omitted, and the driving voltage Vdd may be transmitted to the first node N1 through the driving control transistor Qdd instead of the mobility compensation voltage Vmu. In this case, to prevent the voltage change amount ΔV of the second node N2 from being excessively increased, the mobility compensation time Tmu may be controlled to be small.

Again referring to FIG. 3, in the state that the first scanning signal V1 is maintained as the low voltage Voff, the second scanning signal V2, the third scanning signal V3, and the fifth scanning signal V5 are changed into the low voltage Voff, and the fourth scanning signal V4 is changed into the high voltage Von, such that the emission period S4 starts.

Figure 7:
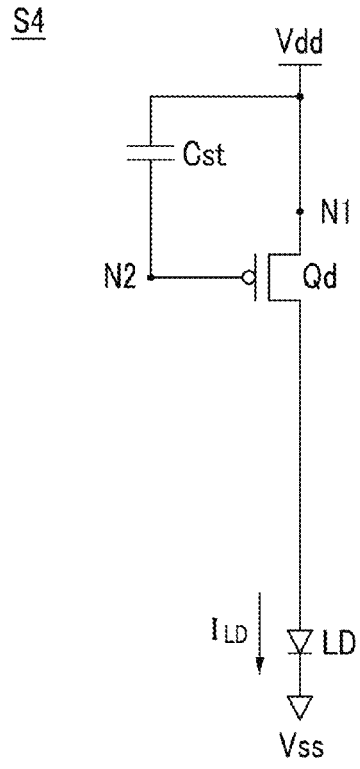
FIG. 7 is an equivalent circuit diagram of a pixel in the period S4 of FIG. 3.

Thus, as shown in FIG. 7, the driving control transistor Qdd and the emission control transistor Qe are turned on and the rest of the transistors Qs, Q1, Q2, and Qr are turned off. Accordingly, the first node N1 is applied with the driving voltage Vdd, and a current $I_{LD}$ flows in the organic light emitting element LD. The output current $I_{LD}$ that flows through the driving transistor Qd and the organic light emitting element LD is controlled by the difference between the voltage VN2 of the second node N2 that is maintained by the capacitor Cst after the mobility compensation period S3 is finished and the driving voltage Vdd. The voltage stored at the capacitor Cst has a value at which deviation of the threshold voltage Vth and the mobility μ of the driving transistor Qd both are compensated. The organic light emitting element LD displays images by emitting light by varying the intensity according to the magnitude of the current $I_{LD}$, as above-described, and the characteristic deviation such as the threshold voltage Vth and the mobility μ of the driving transistor Qd are compensated such that an image having the uniform luminance may be displayed regardless of the position in the display panel 300.

Next, referring to FIG. 3, in the state that the first scanning signal V1, the second scanning signal V2, and the third scanning signal V3 maintain the low voltage Voff and the fourth scanning signal V4 maintains the high voltage Von, the fifth scanning signal V5 is changed into the high voltage Von to start a blanking period S5.

Figure 8:
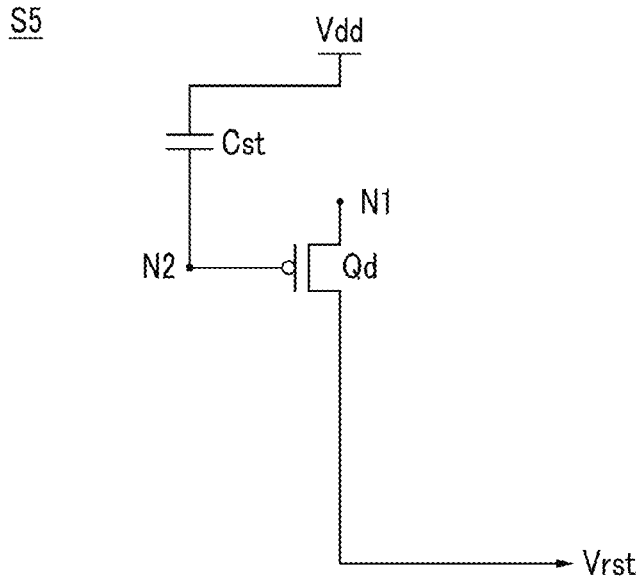
FIG. 8 is an equivalent circuit diagram of a pixel in the period S5 of FIG. 3.

Thus, as shown in FIG. 8, the driving control transistor Qdd, along with the switching transistor Qs, the first compensation transistor Q1 and the second compensation transistor Q2, is turned off, and only the reset transistor Qr and the emission control transistor Qe are turned on, such that the organic light emitting element LD does not emit light. The blanking period S5 forms a period in which the organic light emitting element LD does not emit light along with the reset period S1, the threshold voltage compensation period S2, and the mobility compensation period S3. Here, the pixels PX of the display panel 300 are in a black state during the period when the organic light emitting element LD does not emit light, such that blurred images may be prevented when the organic light emitting device displays a motion picture.

Next, a display operation according to another exemplary embodiment of the present invention of the organic light emitting device shown in FIG. 1 and FIG. 2 will be described with reference to FIG. 11.

Figure 11:
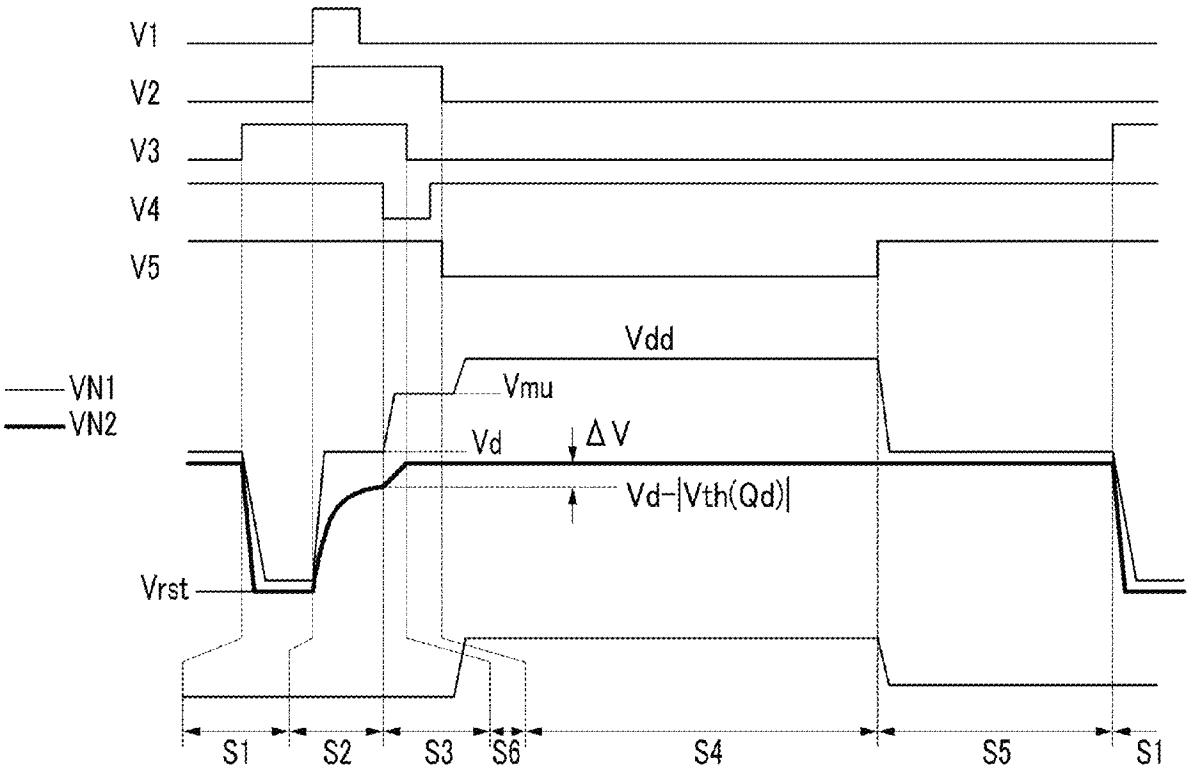
FIG. 11 is a waveform diagram of a driving signal applied to a pixel row and voltages at nodes in an organic light emitting device according to another exemplary embodiment of the present invention.

FIG. 11 is a waveform diagram of a driving signal applied to a pixel row and voltages at nodes in an organic light emitting device according to another exemplary embodiment of the present invention The waveforms of the various driving signals shown in FIG. 11 are mostly the same as the waveforms shown in FIG. 3. That is, a display operation of an organic light emitting device according to an exemplary embodiment of the present invention includes a reset period S1, a threshold voltage compensation period S2, a mobility compensation period S3, an emission period S4, and a blanking period S5 according to the combination of the high voltage Von or low voltage Voff of the first scanning signal V1, the second scanning signal V2, the third scanning signal V3, the fourth scanning signal V4 and the fifth scanning signal V5. However, differently from the exemplary embodiment shown in FIG. 3, a dummy period S6 is further included between the mobility compensation period S3 and the emission period S4.

In the dummy period S6, the first scanning signal V1, the second scanning signal V2, the fourth scanning signal V4 and the fifth scanning signal V5 maintain the same state as that of the mobility compensation period S3, but the third scanning signal V3 is changed to the low voltage Voff. Thus, the first compensation transistor Q1 is turned off, such that the increasing of the voltage of the second node N2 and the compensation of the mobility μ stops. As above-described, by disposing the dummy period S6 between the mobility compensation period S3 and the emission period S4 sufficient time for the fourth scanning signal V4 to be the low voltage Voff may be obtained in the mobility compensation period S3, and the mobility compensation time Tmu in which the third scanning signal V3 is the high voltage Von and the fourth scanning signal V4 is the low voltage Voff may be easily controlled.

Driving signals for two neighboring pixel rows in an organic light emitting device according to another exemplary embodiment of the present invention will be described with reference to FIG. 12.

Figure 12:
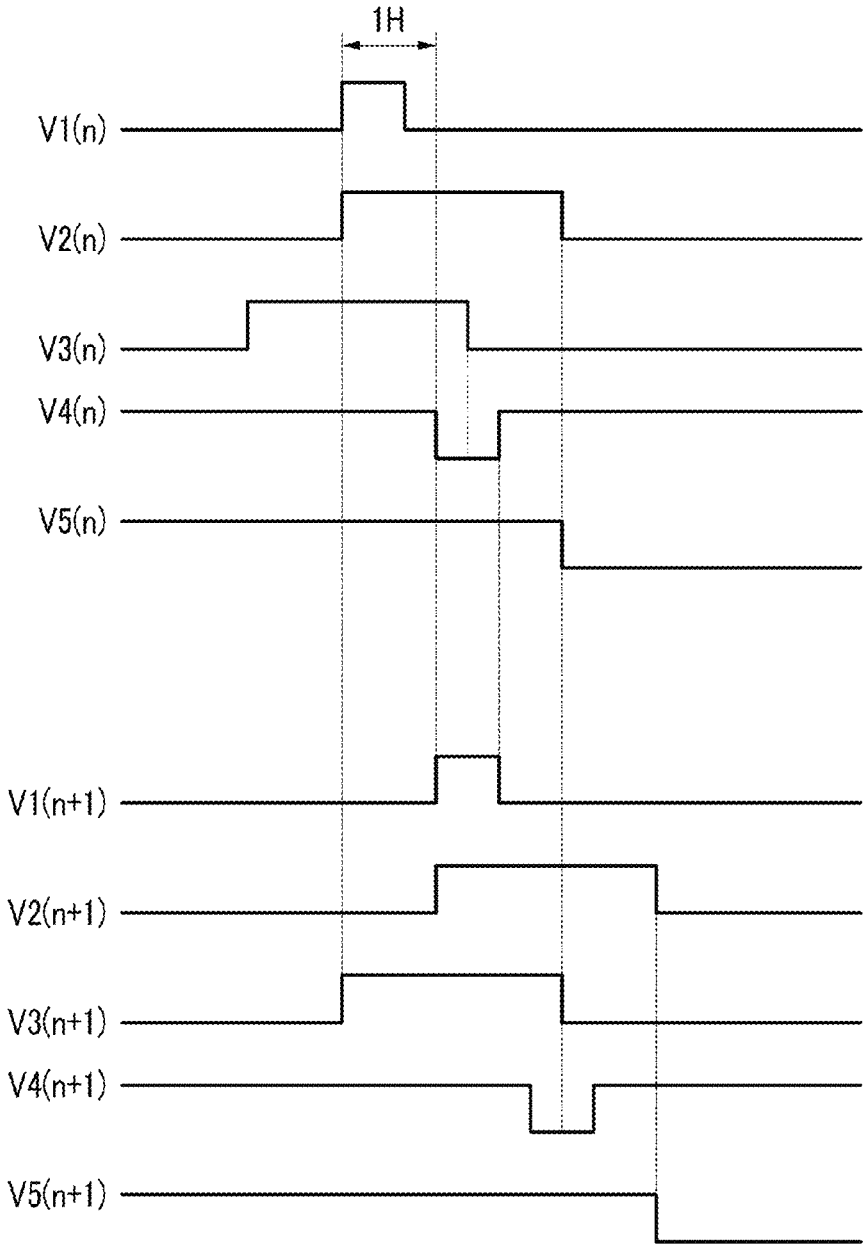
FIG. 12 is a waveform diagram of driving signals applied to two neighboring pixel rows in an organic light emitting device according to another exemplary embodiment of the present invention.

FIG. 12 is a waveform diagram of driving signals applied to two neighboring pixel rows in an organic light emitting device according to another exemplary embodiment of the present invention.

Referring to FIG. 12, the first scanning signal V1, the second scanning signal V2, the third scanning signal V3, the fourth scanning signal V4 and the fifth scanning signal V5 applied to the pixels PX of the n-th and (n+1)-th pixel rows according to the present exemplary embodiment are the same as the driving signals as shown in FIG. 11. The first scanning signal V1, the second scanning signal V2, the third scanning signal V3, the fourth scanning signal V4 and the fifth scanning signal V5 applied to the (n+1)-th pixel row are applied later than the first scanning signal V1, the second scanning signal V2, the third scanning signal V3, the fourth scanning signal V4 and the fifth scanning signal V5 applied to the n-th pixel row by one horizontal period (referred to as "1H" and is the same as one period of the horizontal synchronizing signal and the data enable signal). For example, the first scanning signal V1(n+1) applied to the pixel PX of the (n+1)-th row is changed into the high voltage Von later by one horizontal period than the first scanning signal V1(n) applied to the pixel PX of the n-th row.

On the other hand, as shown in FIG. 12, the third scanning signal V3(n+1) for the (n+1)-th pixel row is the same signal as the second scanning signal V2(n) for the n-th pixel row, and may be applied through the same signal line. Accordingly, circuits for driving the third scanning signal V3 for the remaining pixel rows except for the third scanning signal V3 for the first pixel row may be omitted.

Also, as shown in FIG. 12, the first scanning signal V1(n+1) applied to the (n+1)-th pixel row is a reverse signal of the fourth scanning signal V4(n) for the n-th pixel row. That is the fourth scanning signal V4 for the previous pixel row is reversed through an inverter (not shown) and the reversed signal may be applied to the remaining pixel rows except for the first pixel row as the first scanning signal V1. Accordingly, an additional circuit for driving the first scanning signal V1 for the remaining pixel rows except for the first scanning signal V1 for the first pixel row may be omitted.

As above-described, if the second scanning signal V2 for the n-th pixel row is applied as the third scanning signal V3 for the (n+1)-th pixel row or a reversed signal of the fourth scanning signal V4 for the n-th pixel row is applied as the first scanning signal V1 for the (n+1)-th pixel row, the scan driver 400 may be further simplified.

Next, advantages of the threshold voltage compensation period S2 and the mobility compensation period S3 for a driving transistor Qd according to the exemplary embodiments shown in FIG. 3 and FIG. 11 will be described with reference to FIG. 13 and FIG. 14 as well as FIG. 2, FIG. 3, FIG. 4, FIG. 5, FIG. 6, FIG. 7 and FIG. 8.

Figure 13:
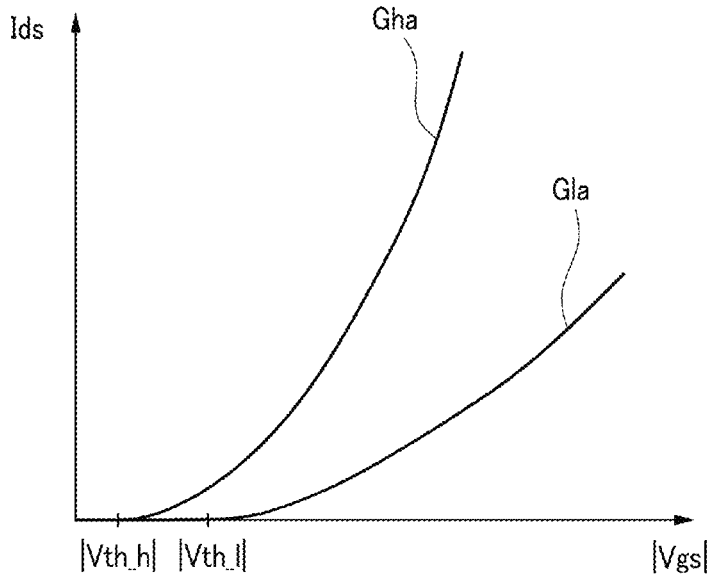
FIG. 13 shows current-voltage curves of driving transistors having different threshold voltages and electric field effect mobility.
Figure 14:
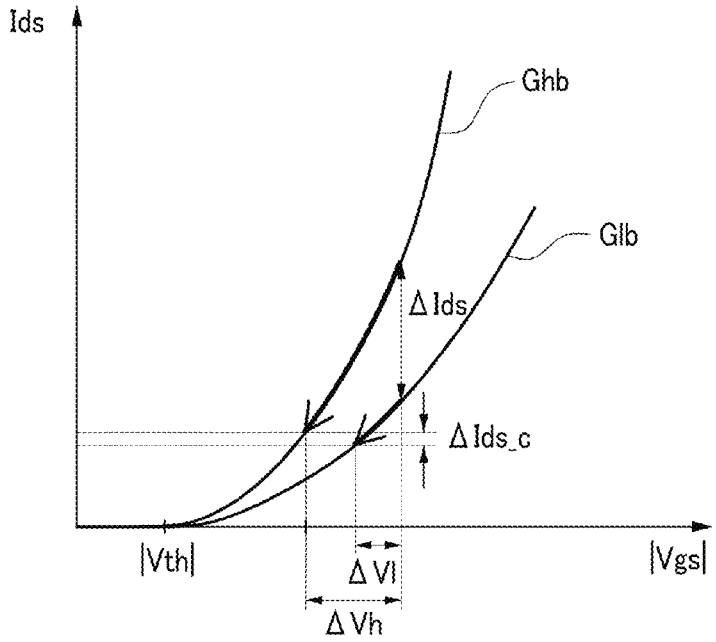
FIG. 14 shows current-voltage curves of driving transistors having different electric field effect mobility after compensating for threshold voltage.

FIG. 13 shows current Ids-voltage |Vgs| curves Gha and Gla of driving transistors having different threshold voltages and different electric field effect mobility. FIG. 14 shows current Ids-voltage |Vgs| curves Gha and Glb of driving transistors having different electric field effect mobility after compensating a threshold voltage. Here, the voltage |Vgs| between the input terminal and the control terminal of the driving transistor Qd may be seen as a voltage stored in the capacitor Cst in each period S1, S2, S3, S4, S5 and S6.

First, referring to FIG. 13, the mobilities μ and the threshold voltages Vth_h and Vth_1 of the driving transistors Qd of the different pixels PX are different from each other. Vd−|Vth_h| and Vd−|Vth_1| are applied to the respective second node N2 connected to the control terminal of the respective driving transistor Qd after the threshold voltage compensation period S2 of FIG. 3 or FIG. 11 passes, such that Vdd−{Vd−|Vth_h|} and Vdd−{Vd−|Vth_1|} are stored at the respective capacitors Cst. Accordingly, the respective capacitors Cst additionally store the threshold voltages Vth_h and Vth_1 of the respective driving transistors Qd, such that deviation of the threshold voltages Vth of the two driving transistors Qd are compensated, as shown in FIG. 14. That is, the respective output currents Ids of the two driving transistors Qd are not influenced by the respective varying threshold voltages Vth_h and Vth_1.

On the other hand, in the mobility compensation period S3 of FIG. 3 or FIG. 11, the voltage VN2 of the second node N2 is increased by a greater change amount ΔVh as the mobility μ of the driving transistor Qd increases than a change amount ΔV1 as the mobility μ becomes smaller. Accordingly, as shown in FIG. 14, the voltage stored in the respective capacitor Cst is decreased as the mobility t of the respective driving transistor Qd increases, such that the deviation ΔIds_c of the output current between the two driving transistors Qd is decreased after the mobility compensation period S3 while the deviation ΔIds of the output current between the two driving transistors Qd before the mobility compensation period S3 is larger. In this way, deviation of the output current Ids of the driving transistors Qd may be reduced by compensating deviation of the mobility μ of the driving transistors Qd. As above-described, the compensation degree of the mobility μ may be controlled by appropriately selecting the mobility compensation time Tmu or the mobility compensation voltage Vmu.

According to an exemplary embodiment of the present invention, deviation of the threshold voltage Vth and the mobility t of the driving transistor Qd are compensated such that images of uniform luminance may be displayed.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a plurality of pixels, wherein each pixel comprises:

a light-emitting element;

a driving transistor comprising an input terminal connected to a first node, a control terminal connected to a second node, and an output terminal;

a capacitor connected between the second node and a driving voltage terminal;

a switching transistor to transmit a data voltage to the first node in response to a first scanning signal;

an emission control transistor connected between the output terminal of the driving transistor and the light-emitting element, the emission control transistor to receive a second scanning signal;

a first compensation transistor connected between the second node and the output terminal of the driving transistor, the first compensation transistor to receive a third scanning signal;

a second compensation transistor to transmit a mobility compensation voltage to the first node in response to a fourth scanning signal;

a driving control transistor to transmit the driving voltage to the first node in response to a fifth scanning signal; and a reset transistor to transmit a reset voltage to the emission control transistor in response to a sixth scanning signal, the reset voltage being applied directly from the reset transistor to the emission control transistor.

2. The display device of claim 1, wherein the switching transistor, the second compensation transistor, and the driving control transistor are turned off, and the first compensation transistor, the emission control transistor, and the reset transistor are turned on, such that the second node is applied with the reset voltage.

3. The display device of claim 2, wherein the reset voltage is less than an emission threshold voltage of the light-emitting element.

4. The display device of claim 2, wherein, after the second node is applied with the reset voltage, the second compensation transistor, the driving control transistor, and the emission control transistor are turned off, and the switching transistor and the first compensation transistor are turned on, such that the first node is applied with the data voltage, and the voltage difference between the first node and the second node becomes an absolute value of the threshold voltage of the driving transistor.

5. The display device of claim 4, wherein, after the first node is applied with the data voltage, the switching transistor, the driving control transistor, and the emission control transistor are turned off, and the first compensation transistor and the second compensation transistor are turned on, such that the first node is applied with the mobility compensation voltage.

6. The display device of claim 5, wherein the mobility compensation voltage is greater than the data voltage and less than the driving voltage.

7. The display device of claim 5, wherein while the first node is applied with the mobility compensation voltage, a change in the voltage of the second node increases as an electric field effect mobility of the driving transistor increases.

8. The display device of claim 5, wherein the first compensation transistor is turned off after a mobility compensation time elapses beginning when the first node starts to be applied with the mobility compensation voltage.

9. The display device of claim 5, wherein after the first node is applied with the mobility compensation voltage, the switching transistor, the first compensation transistor, the second compensation transistor, and the reset transistor are turned off, and the driving control transistor and the emission control transistor are turned on, such that the first node is applied with the driving voltage and the light-emitting element emits light.

10. The display device of claim 9, wherein, after the light-emitting element emits light, the switching transistor, the first compensation transistor, the second compensation transistor, and the driving control transistor are turned off, and the emission control transistor and the reset transistor are turned on, such that the light-emitting element does not emit light.

11. The display device of claim 1, wherein the third scanning signal applied to a pixel row is identical to the second scanning signal applied to a previous pixel row.

12. The display device of claim 1, wherein the first scanning signal applied to a pixel row is an inversion signal of the fourth scanning signal applied to a previous pixel row.

13. The display device of claim 1, wherein the sixth scanning signal is the same signal as the fifth scanning signal.

14. The display device of claim 1, wherein the first scanning signal and the third scanning signal are different from each other.

15. The display device of claim 1, wherein the second scanning signal and the fifth scanning signal are different from each other.

16. A method for driving a display device comprising a light-emitting element, a driving transistor comprising an input terminal connected to a first node and a control terminal connected to a second node, a capacitor connected between the second node and a driving voltage terminal, a switching transistor to transmit a data voltage to the first node, an emission control transistor connected between the driving transistor and the light-emitting element, a first compensation transistor connected between the second node and an output terminal of the driving transistor, a second compensation transistor to transmit a mobility compensation voltage to the first node, a driving control transistor to transmit the driving voltage to the first node, and a reset transistor to transmit a reset voltage to the emission control transistor, the reset voltage being applied directly from the reset transistor to the emission control transistor, the method comprising:

applying the reset voltage to the second node;

compensating a threshold voltage of the driving transistor;

compensating a mobility of the driving transistor; and emitting light at the light-emitting element.

17. The method of claim 16, wherein in the applying of the reset voltage to the second node, the switching transistor, the second compensation transistor, and the driving control transistor are turned off, and the first compensation transistor, the emission control transistor, and the reset transistor are turned on.

18. The method of claim 16, wherein the reset voltage is less than an emission threshold voltage of the light-emitting element.

19. The method of claim 16, wherein, in the compensating of the threshold voltage of the driving transistor, the second compensation transistor, the driving control transistor, and the emission control transistor are turned off, and the switching transistor and the first compensation transistor are turned on, such that the first node is applied with the data voltage, and a voltage difference between the first node and the second node becomes an absolute value of the threshold voltage of the driving transistor.

20. The method of claim 16, wherein, in the compensating of the mobility of the driving transistor, the switching transistor, the driving control transistor, and the emission control transistor are turned off, and the first compensation transistor and the second compensation transistor are turned on, such that the first node is applied with the mobility compensation voltage and a voltage of the second node is changed.

21. The method of claim 16, wherein the mobility compensation voltage is larger than the data voltage and less than the driving voltage.

22. The method of claim 16, wherein in the compensating of the mobility of the driving transistor, the first compensation transistor is turned off after a time elapses beginning when the first node starts to be applied with the mobility compensation voltage.

23. The method of claim 16, wherein in the emitting of light at the light-emitting element, the switching transistor, the first compensation transistor, the second compensation transistor, and the reset transistor are turned off, and the driving control transistor and the emission control transistor are turned on.

24. The method of claim 16, further comprising separating the first node from the driving voltage after the emitting of light at the light-emitting element.

25. The method of claim 24, wherein, in the separating of the first node from the driving voltage, the switching transistor, the first compensation transistor, the second compensation transistor, and the driving control transistor are turned off, and the emission control transistor and the reset transistor are turned on.

* * * * *